US005676401A

United States Patent [19]

Witkowski et al.

[11] Patent Number: 5,676,401

[45] Date of Patent: Oct. 14, 1997

[54] CAN OR PACKAGE LABEL WITH PREMIUM

[75] Inventors: Daniel D. Witkowski; Marcia D. Griffith, both of Plymouth, Minn.

[73] Assignee: Dan Witkowski Presents, Inc., Minneapolis, Minn.

[21] Appl. No.: 518,746

[22] Filed: Aug. 24, 1995

[51] Int. Cl.[6] ..... B42D 15/00

[52] U.S. Cl. ..... 283/81; 283/97; 283/101; 40/306; 40/310; 428/914

[58] Field of Search ..... 283/81, 71, 95, 283/97, 51, 56, 100, 101, 114; 40/306, 310, 312; 206/831; 428/914

[56] References Cited

U.S. PATENT DOCUMENTS

| | | | |
|---|---|---|---|
| 1,054,826 | 3/1913 | Cole | 283/81 |
| 1,145,367 | 7/1915 | Herter | 40/306 |
| 1,756,944 | 5/1930 | Gorton, Jr. | 40/306 |
| 1,974,401 | 9/1934 | Miller | 40/306 |
| 1,982,282 | 11/1934 | Bock | 40/310 |
| 2,093,985 | 9/1937 | Stansbury | 206/831 |
| 2,254,545 | 9/1941 | Roberts | 283/56 |
| 3,524,782 | 8/1970 | Buske | 156/248 |
| 3,638,340 | 2/1972 | Gottschalk | 40/306 |
| 3,704,892 | 12/1972 | Moravick et al. | 273/157 R |
| 3,835,564 | 9/1974 | Gottschalk | 40/306 |
| 4,308,679 | 1/1982 | Ray, III et al. | 40/312 |
| 4,336,664 | 6/1982 | Penick et al. | 40/312 |
| 4,551,373 | 11/1985 | Conlon | 428/43 |
| 4,634,149 | 1/1987 | Donovan | 283/81 |
| 4,648,548 | 3/1987 | Shin | 40/312 |
| 4,846,504 | 7/1989 | MacGregor et al. | 283/81 |

*Primary Examiner*—David P. Bryant
*Attorney, Agent, or Firm*—James A. Geppert

[57] ABSTRACT

A label for a container in the form of a metallic generally cylindrical can or glass or plastic bottle wherein the label encompasses and surrounds the outer side surface of the container, the label carrying suitable advertising matter on the exterior surface identifying the contents of the container and identifying the source of the container as well as itemizing the ingredients of the food or beverage therein, and the internal surface of the label having printed thereon one or more removable, temporary transfer tattoos which may be easily transferred from the label, when removed from the container, to the skin a child for his or her enjoyment and entertainment.

11 Claims, 4 Drawing Sheets

CAN OR PACKAGE LABEL WITH PREMIUM

FIELD OF INVENTION

The invention disclosed herein relates to novel packaging for food or beverage containers, wrappers, liners or other packaging having a "premium play element" applied to the packaging on the label or other wrapper for use by a consumer, such as a child, for entertainment after consumption of the product.

BACKGROUND

Cereal companies have long enjoyed the benefits of using toys or other premiums inside their boxes or containers to stimulate consumer interest in their products. Whistles, books, comics, rings, finger puppets and other children's playthings have been inserted into boxes or containers to add play value to the experience of eating cereal or snacks. Producers of other products such as foodstuffs sold in cans, bottles, tubes, rolls, tubs or other containers have found it difficult, expensive or virtually impossible to add a "premium play element" to their products because there has not been an efficient and cost effective method to deliver the premium to the consumer.

Cereal boxes provide a large, dry environment for reception of a toy or other premium, while cans, tubs, bottles and similar containers do not allow for the insertion of premiums because of potential contamination and safety hazards for consumers. To place an item on the exterior of a package traditionally has necessitated additional packaging equipment be brought into the manufacturing plant with a resultant reduction in production line speeds and virtual reconfiguration of the entire manufacturing and packaging line to add the premium component. This process has been time consuming, costly and inefficient.

While the backs of labels have been used to deliver coupons or special messages for consumers, they have been limited to standard printing inks, with no real play value for children; things such as word games, coloring pictures or puzzles. Inks that can change color, glow-in-the-dark, or scratch-off present numerous problems in packaging since pigments and materials that make these inks are raised above the surface of the label material, which labels are generally dispensed from magazines or trays that require that the labels be perfectly flat as they are applied to the containers.

Temporary tattoos have been known for approximately forty years, however, the tattoo inks in the form of water soluble dyes are generally printed using a process known as flexography, which printing process may be compared to a rubber stamp for the transfer of ink to a sheet of paper where a rubber or synthetic (flexible) printing plate is utilized in a web press using paper on rolls rather than sheets. However, web presses are not normally wide enough to efficiently print the backs of can labels.

The present invention relates to an improved product and method for producing the product to allow a company that manufactures a canned or bottled product to provide a paper label therefor that delivers significant added "play value" for children by efficiently delivering removable temporary tattoos to the back surface of the label.

SUMMARY OF THE INVENTION

The present invention relates to an improved product and method for the manufacture of can or other container labels which have on the inner surface opposite to the advertising information on the exterior surface the ability to print valuable play element premiums thereon for use and enjoyment by children who consume the products in the can, bottle or container. In the present instance, the play premiums are temporary tattoos which are printed on the inner surface of the label and, once the label is removed from the container, the tattoos are exposed for use and enjoyment by the child or children who consume the food product in the can, bottle or other container. The premiums are printed on the surface of the paper for the label with inks that dry flat without sticking together, which assures that the application equipment will not be hampered by stacks of uneven labels that bulge or stick together because of heavy ink coverage over the back Surface of the paper.

The present invention also comprehends the provision of a method or process to produce and dispense labels that does not require any special application equipment in the manufacturing plants, or changes in the manufacturing process at the canning or bottling facility. The process does not slow down the production lines, and the process is not affected by heat from the cans or containers as they exit the manufacturing line out of a cooker.

By producing the premium directly on the back surface of the label, one is assured that the premium is delivered on each and every can with 100% accuracy. If a separate premium is independently placed under the can label, it is much more difficult to confirm that the premium is on every can. The use of a tattoo premium realizes that the premium can be produced on the same weight and grade of paper used for most paper labels which means that the calibrations for the application equipment will not have to be reset for the new labels. In addition to paper labels, the present invention can be incorporated into wrappers, boxes, liners, bags and other containers or barriers for food or beverage products.

MODES FOR CARRYING OUT THE INVENTION

Figure 1:
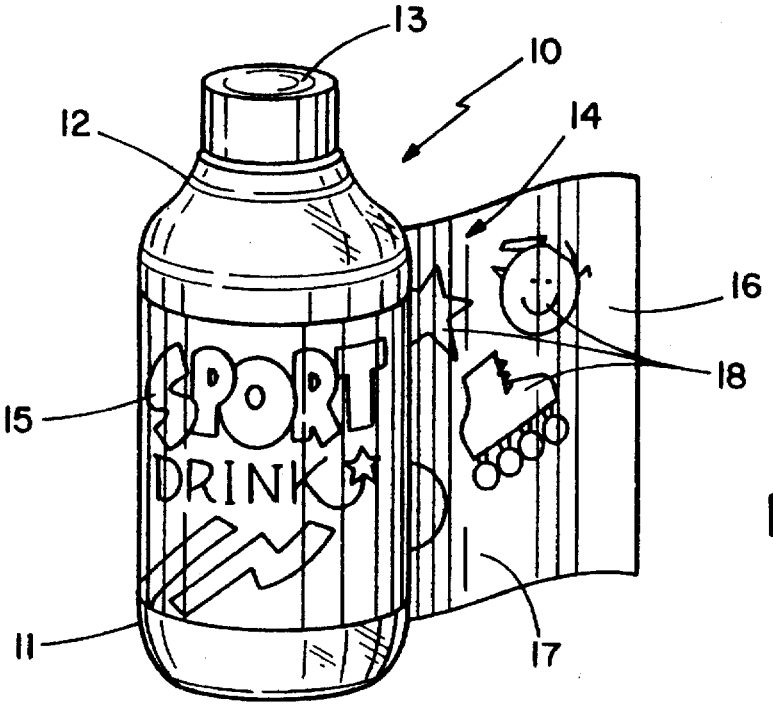
FIG. 1 is an illustrative perspective view of a bottle having the label of the present invention partially applied thereto showing the tattoos on the inner surface of the label.

Referring more particularly to the disclosure in the drawings wherein are shown illustrative embodiments of the present invention, FIG. 1 discloses a soft drink bottle 10 of an appropriate size having a generally straight side 11 with a narrowed neck 12 leading to a screw top portion receiving a bottle top 13 to close the bottle and prevent the escape of the beverage and/or the carbonation therein. An elongated label 14 is applied around the bottle to encompass it and provide advertising 15 showing the identity of the contents of the bottle as well as the source of the product and ingredients thereof. The label is provided with glued end portions 16 to adhere to the bottle side surface and an intermediate portion 17 having printed thereon one or more tattoo FIGS. 18 which are water soluble and, when the label is removed from the bottle, can be transferred onto the skin of a child for his or her entertainment and play.

Figure 2:
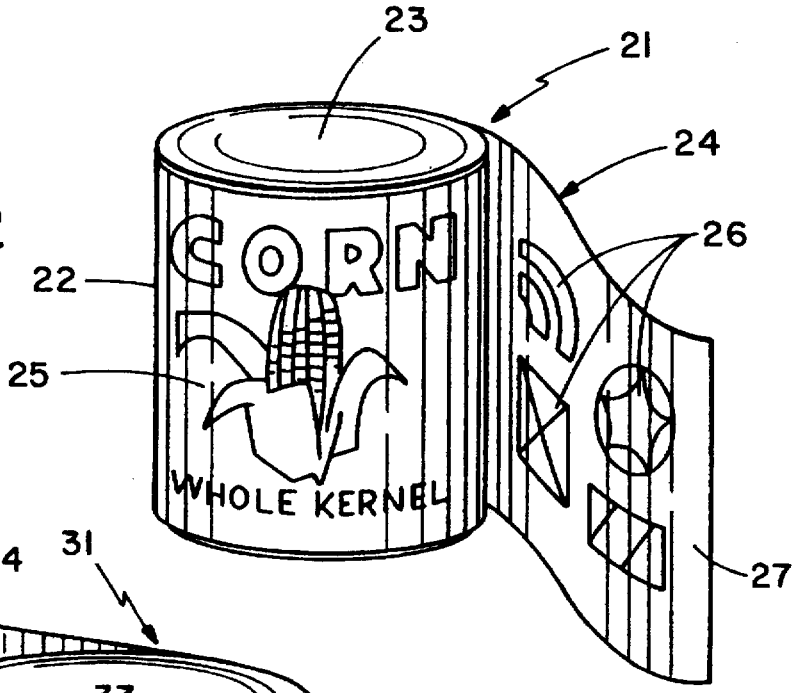
FIG. 2 is a perspective view similar to FIG. 1 but showing a label applied to a metallic can for a food product.
Figure 3:
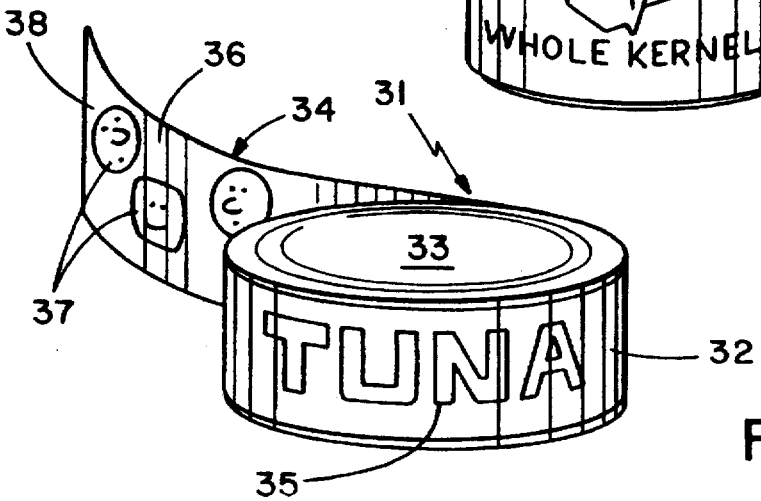
FIG. 3 is a perspective view similar to FIG. 2, but showing a label applied to another size and shape of container.

FIG. 2 is similar to FIG. 1, but the container 21 is in the form of a metallic container or can to house perishable contents sealed inside, the can being formed with a generally straight side 22, an upper end 23 and a lower end (not shown) sealed together. Applied to the can is an elongated label 24, similar to the label 14 of FIG. 1, having advertising of the product on the exterior surface 25 and one or more play tattoos 26 on the interior surface. The free ends 27 of the label are provided with glue areas for securing the label to the can. A second type of can or container 31 is shown in FIG. 3, which typically is used for cans of tuna fish or similar products, the can having a shortened generally straight sidewall 32, a top end wall 33 and a lower end wall (not shown) to seal the contents in the container. An elongated narrow label 34 is shown for the advertising 35 of the product and tattoos 37 on the inner surface 36 of the label, as well as glue areas 38 similar to the label of FIG. 2.

Figure 4:
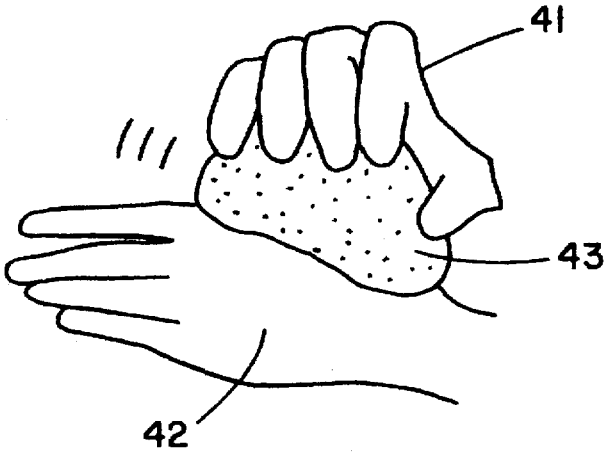
FIG. 4 is an illustrative view of a person's hands where moisture is applied to the back of one hand for application of a tattoo.
Figure 5:
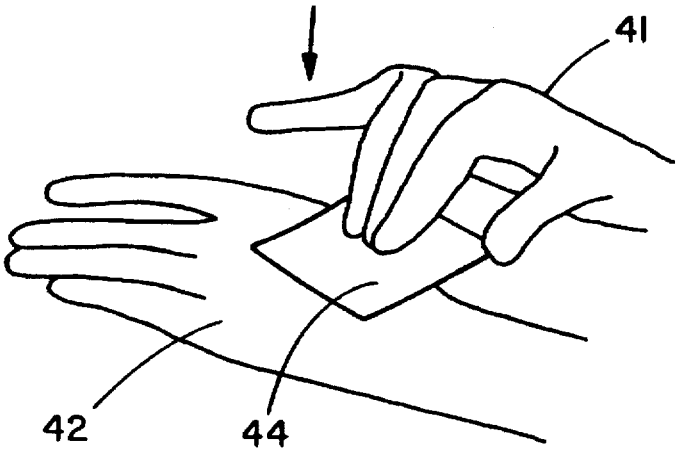
FIG. 5 is a view similar to FIG. 4, but showing the application of a transferable tattoo from the label of the present invention.
Figure 6:
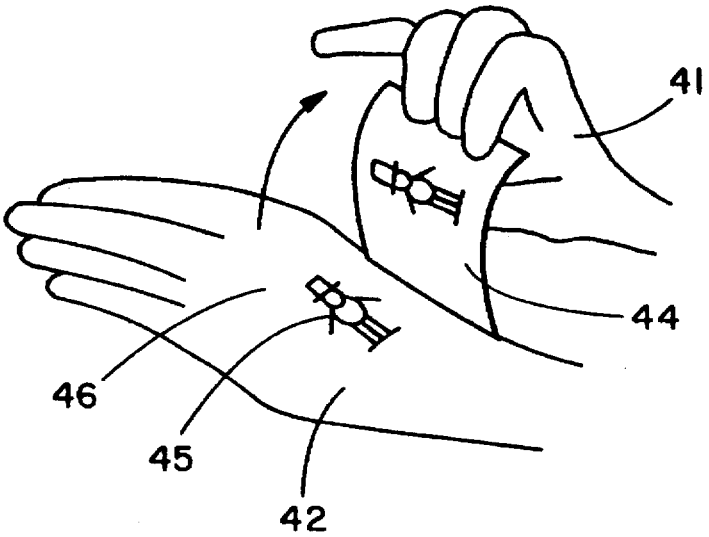
FIG. 6 is a view similar to FIG. 4, but showing the tattoo being transferred onto the back of the hand as the label is removed.

FIGS. 4, 5 and 6 of the drawings disclose the application of a tattoo from a container label to the back of the hand of a child once the label is removed from the container. In FIG. 4, the right hand 41 of the user is applying moisture onto the back of the left hand 42 by a sponge or damp cloth 43. In FIG. 5, the label 44 from a container, such as shown in either FIG. 1, 2 or 3, is pressed onto the moistened hand 42 to transfer the ink or dye of the tattoo from the label inner surface to the hand. Then, in FIG. 6, the right hand 41 peels away the label 44 with the resultant tattoo 45 being printed on the back 46 of the left hand 42. The tattoo on the label is printed onto the paper surface of the label by the use of water-soluble, vegetable dyes that are easily transferred onto the skin from the carrier sheet (label) and are printed with water.

Figure 7:
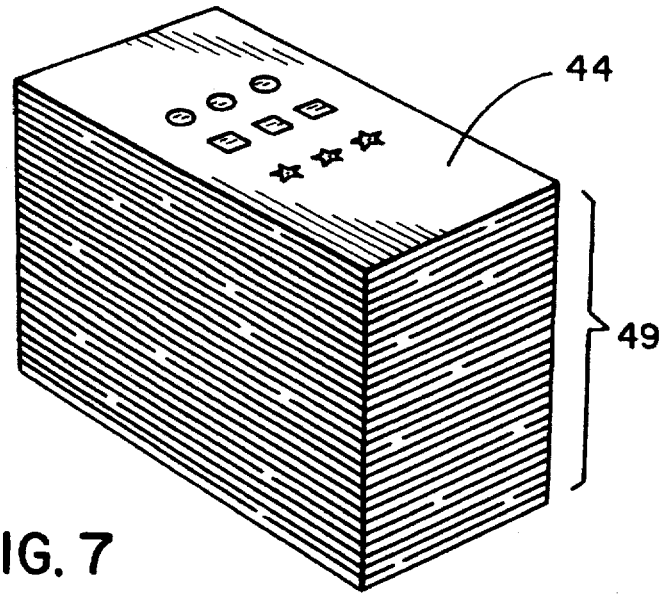
FIG. 7 is a perspective view of a stack of labels with printed tattoos thereon for feeding from a tray onto the exterior surfaces of the containers.
Figure 8:
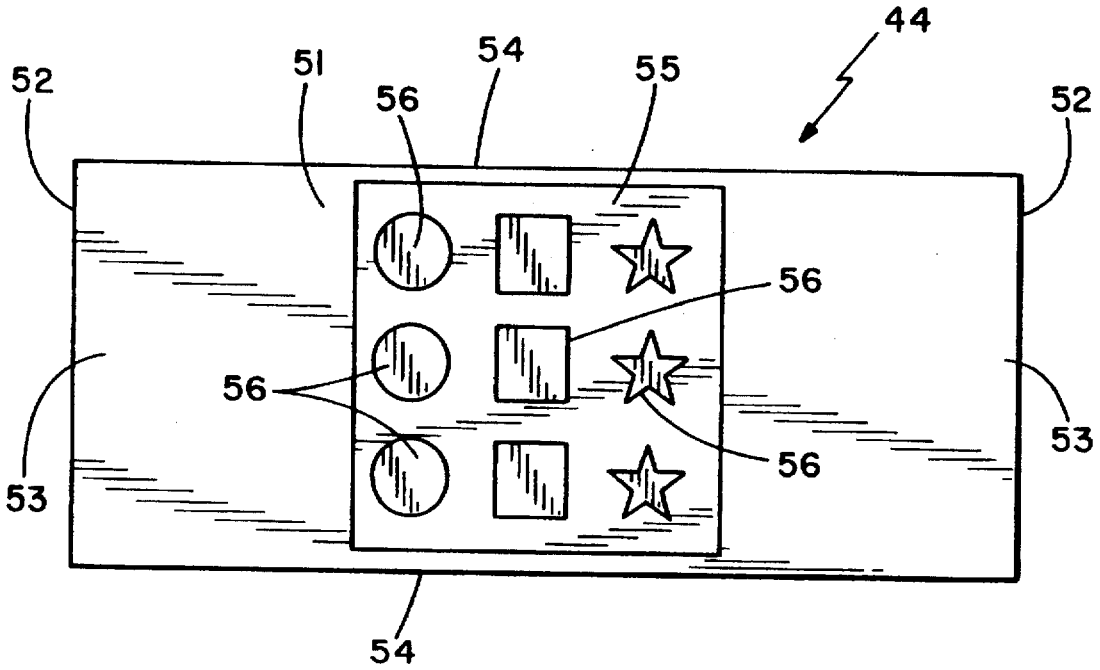
FIG. 8 is a top plan view of a label showing the internal surface with printed tattoo.

As seen in FIG. 7, a stack 49 of labels 44 for application to a container are printed with inks or dyes that dry flat without sticking together, unlike other novelty printing inks such as scratch-off, glow-in-the-dark, or transfers which cannot be efficiently utilized in a similar manner. This assures that the application equipment in the form of a magazine or tray will not be hampered by stacks of uneven labels that bulge or stick together because of heavy ink coverage over the back surface. FIG. 7 shows the stack 49 of labels which would be inserted in a magazine or tray for feeding therefrom to be applied onto the containers and wrapped therearound. FIG. 8 discloses a label 44 of the stack having an interior surface 51 with glue areas 53, 53 at the opposite ends 52 and a central area 55 spaced from both ends 52 and both elongated edges or sides 54. Within this area are the tattoo or tattoos 56 which are printed on the surface with water soluble vegetable dyes. The tattoos are printed from pure or screened process colors, and the artwork for the tattoos has a bold, simple graphic design.

Figure 9:
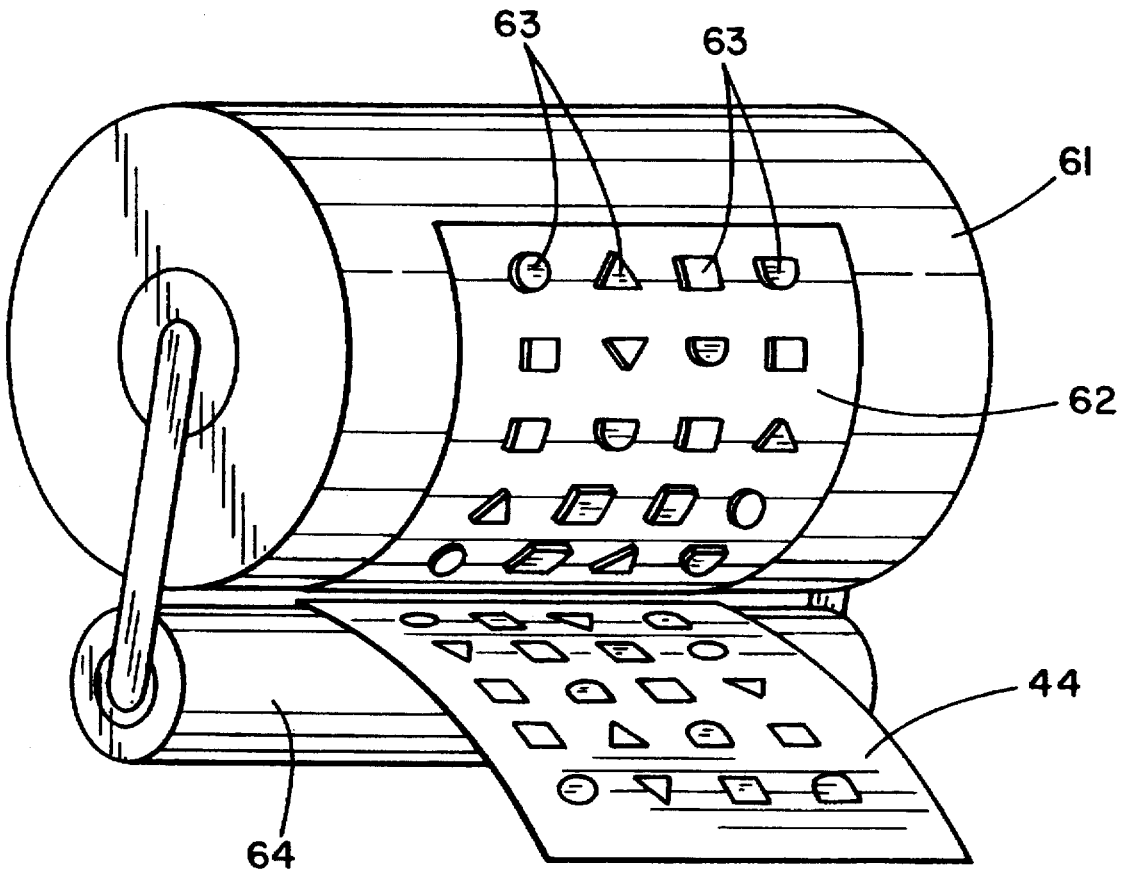
FIG. 9 is a perspective view of a flexographic printing roller for printing the tattoos onto the internal surface of a label.

FIG. 9 discloses a flexographic printing plate 62 on a roller 61 having raised areas 63 thereon for the printing of a tattoo figures onto a label 44, the ink being fed from a tray onto the roller from a transfer roller (not shown) and an idler roller 64 is mounted to yieldably urge the label and press the label against the flexographic roller 61. The graphics for the tattoos are of the highest quality of image because the inks have been blended on the press to create various shades and tints. The printing roller 61 for the tattoos is installed in a conventional offset press. Normally flexographic presses are not wide enough to efficiently print the backs of can labels, which are generally printed on sheet-fed offset presses. Replacing the traditional flat offset plates with raised flexographic plates, however, solves the printing problem. Also, it is essential to eliminate any water from the wells on the offset press which is used to pick up the ink on the printing plate and transfer the image to a rubber blanket (roller) which then transfers the ink to the paper. The blending of inks is generally limited to two colors, printed with a screened dot pattern to achieve a third color. With the traditional four-color printing process, colors can be screened and over-printed in various combinations to achieve a large palette of colors.

As tattoo inks are water soluble and particularly vulnerable to moisture, including humidity, which can cause the inks to release prematurely from the label and bleed through the label, the process for the tattoos require controls in the form of container dryers and blowers on the manufacturing lines to reduce residual moisture and, during high humidity conditions in plants, it may also be necessary to introduce cooling systems to insure that condensation that may collect on the containers as they go through the filling and labelling process will not cause the labels to bleed.

In addition to paper labels, the invention can be incorporated into wrappers, boxes, liners, bags and other containers or barriers for food or beverage products which are directed toward consumption by a child or children as the primary consumer.

We claim:

1. A wrapper for a container of a food or beverage product wherein said wrapper is formed of a paper material with internal and external surfaces, said external surface carrying printing advertising the contents of the container, and said internal surface carrying a premium play element for children comprising a temporary transfer tattoo printed on and removable from said internal surface to be used by removing the wrapper from the container.

2. A wrapper as set forth in claim 1, in which said tattoo is printed in water-soluble inks or dyes.

3. A wrapper as set forth in claim 1, in which said tattoo is printed on the internal surface by a flexographic printing plate in an offset press.

4. A wrapper as set forth in claim 1, in which said internal printed surface is substantially flat so as to be capable of being fed from a magazine or tray in a stack.

5. A wrapper as set forth in claim 1, in which said wrapper is a label with said internal surface zoned to provide a glue area at each end to secure the label to a container and a separate zoned area for said tattoo.

6. A wrapper as set forth in claim 1, in which said container receiving the wrapper is a metallic can.

7. A wrapper as set forth in claim 1, in which said container receiving said wrapper is a glass or plastic bottle.

8. A wrapper as set forth in claim 1, in which said tattoo is printed from pure or screened process colors.

9. A wrapper as set forth in claim 1, in which the tattoo is provided with artwork having a bold, simple graphic design.

10. In combination with a container, an advertising device secured about and conforming to the exterior surface of the container, said device comprising a paper sheet forming a wrapper having external and internal surfaces, a label printed on said external surface indicating the contents of the container, and a premium play element printed on said internal surface in the form of temporary transfer tattoos for the entertainment and enjoyment of children consuming the contents of said container.

11. The combination as set forth in claim 10, wherein said temporary transfer tattoos are both removable from the surface of said wrapper and from the user.

* * * * *